US006621909B1

(12) United States Patent
Webb et al.

(10) Patent No.: US 6,621,909 B1
(45) Date of Patent: Sep. 16, 2003

(54) HORN LOUDSPEAKER AND LOUDSPEAKER SYSTEMS

(75) Inventors: William Webb, Bucks (GB); Paul Darlington, Salford (GB); Oliver Wright, Salford (GB)

(73) Assignee: Martin Audio Limited (GB)

( * ) Notice: Subject to any disclaimer, the term of this patent is extended or adjusted under 35 U.S.C. 154(b) by 382 days.

(21) Appl. No.: 09/199,751

(22) Filed: Nov. 25, 1998

(30) Foreign Application Priority Data

Nov. 28, 1997 (GB) ..... 9725345

(51) Int. Cl.[7] ..... H04R 25/00

(52) U.S. Cl. ..... 381/342; 381/182; 381/340; 181/144; 181/152

(58) Field of Search ..... 381/340, 339, 381/111, 150, 337, 341, 342, 386, 182, FOR 140, FOR 141, FOR 142, FOR 143; 181/144, 152, 159, 175, 177, 179, 192, 198, 199

(56) References Cited

U.S. PATENT DOCUMENTS 2,194,664 A * 3/1940 McDonald ..... 381/340
4,391,346 A * 7/1983 Murakami et al. ..... 181/147
4,437,540 A * 3/1984 Murakami et al. ..... 181/147
4,733,749 A * 3/1988 Newman et al. ..... 181/144
5,432,860 A * 7/1995 Kasajima et al. ..... 381/340
5,526,456 A * 6/1996 Heinz ..... 381/182
5,784,474 A * 7/1998 Kohut et al. ..... 381/340
6,038,326 A * 3/2000 Czerwinski ..... 381/340
6,118,883 A * 9/2000 Rocha ..... 381/340

* cited by examiner

*Primary Examiner*—Xu Mei
(74) *Attorney, Agent, or Firm*—Hodgson Russ LLP

(57) ABSTRACT

A horn loudspeaker comprises: a horn (22) having a throat (26) and a mouth (30); a primary electro-acoustic driver (24) mounted at or adjacent the throat of the horn and directed generally along the horn; and at least one secondary electro-acoustic driver (32T, 32B, 32L, 32R) mounted part-way along the horn and directed generally across the horn. The secondary driver(s) can be used to change the local impedance conditions in the horn and therefore to change the polar response of the horn loudspeaker. At least one filter (12A, 12E) is provided for filtering an input signal (34) for the primary driver to produce a filtered signal for the primary driver or each of the secondary drivers. Such a filter may be chosen or designed so as to optimize some aspect of the polar response of the horn loudspeaker, for example to increase directivity, or flatten the polar response within a specified included radiation angle, or to increase omnidirectionality.

15 Claims, 3 Drawing Sheets

HORN LOUDSPEAKER AND LOUDSPEAKER SYSTEMS

CROSS REFERENCE TO RELATED APPLICATION

The present application claims priority based on United Kingdom application Ser. No. 9725345.4 filed Nov. 28, 1997.

BACKGROUND OF THE INVENTION

1. Field of the Invention

This invention relates to horn loudspeakers and loudspeaker systems.

2. Prior Art

Horn loudspeakers are well known and typically comprise a horn, which may have, for example, a conical, exponential or hyperbolic taper, with a throat and mouth, and an electro-acoustic driver mounted at or adjacent the throat of the horn and directed generally along the horn.

The horn loading of the driver offers significant increases in overall electro-acoustic efficiency and can control the radiating pattern of the driver. Unfortunately, the pattern control achieved by horn loading a loudspeaker is imperfect and is frequency dependent, despite the claims of so-called constant directivity horns.

The directivity of a well designed horn is reasonably constant down to a lower limiting frequency. Below this frequency, the directivity decreases significantly and the horn loses its directional control. The frequency at which directivity control is lost is inversely proportional to the size of the horn mouth, making it difficult to produce small horns with good control of low frequency directivity. See for example Henricksen and Ureda "The Manta-Ray Horns", Journal of the Audio Engineering Society, 1978, who suggest an expression for the break frequency below which pattern control is lost of form:

$$f_{break=\frac{k}{\theta X}}$$

where

X horn mouth size (m)

θ Coverage angle (degrees)

K constant: 25400 (degree metres/Hz)

The horn controls the acoustic radiation impedance seen by the driver, and the horn profile couples the radiation load at the throat to the acoustics of waves in free air after the mouth. The profile of the horn causes a changing acoustic impedance for waves propagating from the driver, down the horn, and out into the listening space. This changing impedance influences the polar response of the horn.

SUMMARY OF THE INVENTION

In accordance with the present invention, there is provided a horn loudspeaker, comprising: a horn having a throat and a mouth; a primary electro-acoustic driver mounted at or adjacent to the throat of the horn and directed generally along the horn; and at least one secondary electro-acoustic driver mounted party-way along the horn, spaced from the throat, and directed generally across the horn.

There may be a signal conditioning means for conditioning input signals to at least one said secondary driver to control the polar response of the horn loudspeaker.

In accordance with a second aspect of the present invention, there is provided a horn loudspeaker system, comprising: a horn having a throat and a mouth; a primary electro-acoustic driver mounted at or adjacent to the throat of the horn and directed generally along the horn; at least one secondary electro-acoustic driver in a side surface of the horn and directed generally across the horn; and means for processing input signals to at least one said secondary driver to control the polar response of the horn loudspeaker.

The signal processing means may process an input signal for the primary driver to produce a processed signal for the or each secondary driver.

The signal processing means may select at least one frequency component (frequency band) of the input signal for processing.

The signal processing means may be chosen or programmed (e.g. if it is a digital filter or other digital signal processor) so as to optimise some aspect of the polar response of the horn loudspeaker, for example to increase directivity, to flatten the polar response within a specified included radiation angle (for example approximating an ideal $n^0$ x $n^0$ perfect radiator), or to increase omnidirectionality. Means are preferably provided for adjusting the filtering or other processing characteristic of the signal processor, for example so that the polar response of the horn loudspeaker can be selected at the flick of a switch or twist of a knob. The system may further include: means for amplifying the input signal for supply to the primary driver; and means for amplifying the processed signal(s) for supply to the secondary driver(s). The signal processing can then be done at line level.

In a preferred form of the invention, the signal processing means comprises frequency selective networks (filters), implemented using either conventional (analog) or discrete time (digital) technologies. Each filter response is designed to provide an appropriate ratio between the electrical signal to the primary driver and the electrical signal to the secondary driver(s). This ratio ultimately determines the acoustic impedance at the surface of the primary and secondary driver(s) thus influencing the radiation load presented to the primary driver and the overall directivity of the horn loudspeaker.

There may be a range of user-selectable filter settings to give a single horn a range of directivity patterns.

The response of each filter may be designated by setting the filter parameters by i) manual adjustment, or ii) explicit optimisation (eg. Wiener Optimal Filtering) or iii) automatic numerical optimisation routines (e.g. Genetic Algorithms).

Preferably at least two such secondary drivers are provided. In this case, the secondary drivers are preferably arranged as one or more pairs, at least one of the drivers of each pair being arranged generally symmetrically with respect to the horn axis and having their electrical inputs connected in phase with each other. Thus the secondary drivers do not affect the acoustic axis of the horn loudspeaker. One such pair of secondary drivers may be provided, but preferably at least two such pairs are provided. In this case, the secondary drivers of a first of the pairs are preferably directed generally in a first plane generally across the axis of the horn; and the secondary drivers of a second of the pairs are preferably directed generally in a second plane, generally at right angles to the first plane, generally across the axis of the horn. Thus, for example, the polar response can be altered in both azimuth and elevation. Also, the signal processing means is preferably arranged to produce a first such processed signal for one of the pairs of secondary drivers and a second such processed signal for another of the pairs of secondary drivers. Accordingly, the azimuthal and elevational responses can be altered in different ways.

Preferably, the secondary driver, or at least one of the secondary drivers, is disposed nearer the mouth than the throat of the horn, which preferably has an exponential or hyperbolic taper.

Preferably, the primary driver or each of the secondary drivers is mounted in the wall of the horn and is directed generally at right angles to the portion of the wall in which it is mounted.

BRIEF DESCRIPTION OF THE DRAWINGS

A specific embodiment of the present invention will now be described, purely by way of example, with reference to the accompanying drawings, in which.

DETAILED DESCRIPTION OF THE PREFERRED EMBODIMENTS

Figure 1:
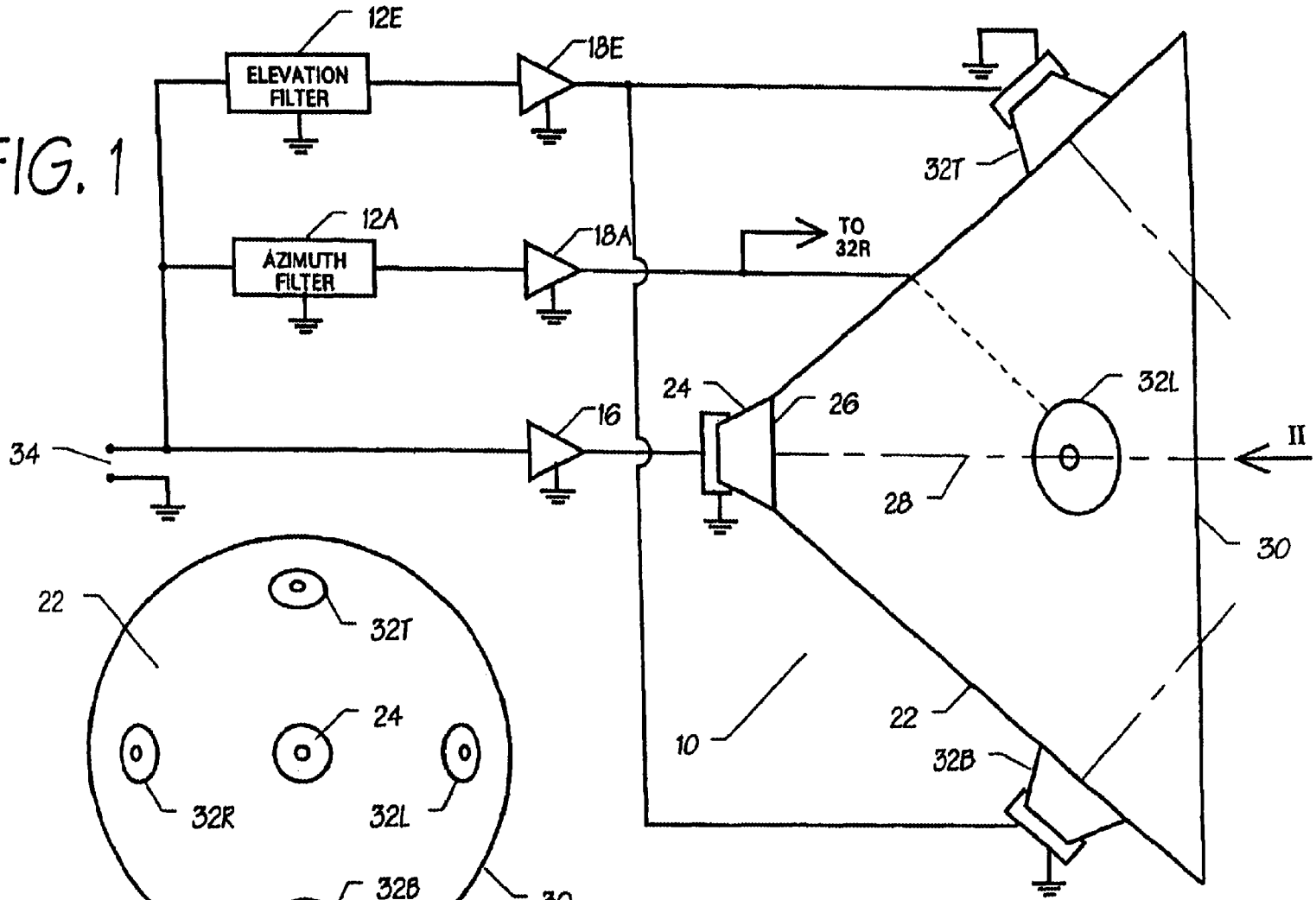
FIG. 1 is a schematic diagram of an embodiment of loudspeaker system, with the loudspeaker horn shown sectioned.

Referring to FIG. 1, a horn loudspeaker system includes a horn loudspeaker 10, an elevation signal processor 12E, an azimuth signal processor 12A, a primary amplifier 16, an azimuth amplifier 18A and an elevation amplifier 18E. The loudspeaker 10 has a horn 22 which for simplicity in the drawing is shown as a conical horn, but which preferably has an exponential or hyperbolic form. A primary driver 24 is attached to the throat 26 of the horn 22 such that the axes 28 of the primary driver 24 and of the horn 26 coincide. About two-thirds to four-fifths of the way along the horn 22 from the throat 26 to its mouth 30, four secondary drivers 32T, 32B, 32L, 32R, each provided by a cone loudspeaker, are mounted in the wall of the horn 22 towards the top, bottom, left and right, respectively, of the horn 22 as viewed along the axis 28 from the primary driver 24. The axes of the loudspeakers 32T, 32B, 32L, 32R are generally at right angles to the portions of the wall of the horn 22 in which those loudspeakers are mounted.

An input signal 34 is supplied to the primary amplifier 16, whose output drives the primary driver 24. The input signal 34 is also supplied to the elevation and azimuth signal processors 12E, 12A, whose outputs are supplied to the elevation and azimuth amplifiers 18E, 18A. The output of the elevation amplifier 18E is supplied to the top and bottom secondary drivers 32T, 32B in parallel so that they vibrate in phase with each other, and the output of the azimuth amplifier 18A is supplied to the left and right secondary drivers 32L, 32R in parallel so that they vibrate in phase with each other.

The elevation and azimuth signal processors 12E, 12A are each provided by a respective digital signal processor ("DSP"), which can be programmed to select (i.e. filter) any frequency component, or at a series of frequency components of the input signal 34 in the audio spectrum, and to modify the phase and/or amplitude of the selected component(s). The design of the filters 12E, 12A is dependent upon the electro-acoustic performance of the primary and secondary drivers 24, 32T, 32B, 32L, 32R, the horn geometry and the location of the secondary drivers within the horn 22, such that a general solution for the optimal filter cannot be specified. Each filter 12E, 12A has to be individually designed for each new application. Since the performance of practical horn loaded loudspeakers cannot be determined analytically, the optimal filter design is obtained from an iterative method.

In order to design the filters 12E, 12A, the loudspeaker system is placed in a free-field situation (in practice in an anechoic chamber). The polar response of the loudspeaker 10 is determined using an array of microphones positioned at equal intervals on an arc such that all of the microphones are equidistant from the acoustic centre of the loudspeaker 10. The number of microphones used will determine the resolution with which the polar response is sampled and therefore influences the resolution to which the radiation pattern can potentially be controlled.

In the case where, say, the elevation filter 12E, elevation amplifier 18E and top and bottom secondary drivers 32T, 32B are not used, let the number of microphones be N which are indexed by i. Also, let the filter function of the azimuth filter 12A be H and its current configuration be $H_k$. The desire polar response (expressed, for example, with respect to the response on the axis 28) at the location of each microphone is specified as $d_i$. The actual polar response is specified by the measured responses at each of the microphone locations as y.

The difference between the desired polar response $d_i$ and the actual polar response $y_i$ constitutes a polar response error $e_i$. When this error $e_i$ is zero, the system has the desired polar response at the microphone i. However it is unlikely that it will be possible to produce a zero error $e_i$ at all of the N microphones. Accordingly, a total magnitude squared error $e^2$ is chose as a measure of the error, where: When $e^2$ is minimized, the polar response matches the target as closely as is feasible, given the drivers, the geometry chosen and the microphones sampling the polar response. The minimum value of the total magnitude squared error $e^2$ is associated with $$e^2 = \sum_{i=1}^{i=N} |d_i - y_i|^2 \tag{1}$$

the optimum configuration, $H_{opt}$ of the azimuth filter 12A.

The optimum configuration $H_{opt}$ can be identified iteratively using adaptive optimisation techniques, such as gradient searching and genetic methods, which have been shown to be capable of minimizing the total magnitude square error $e^2$ in an experimental environment. The gradient searching technique will be described below.

Given the current configuration of the filter $H_k$, an improvement can be made using a steepest descent gradient searching method by making a change in the direction of the negative gradient:

$$H_{k+1} = H_k - \alpha \cdot \frac{\partial e^2}{\partial H_k} \tag{2}$$

where $\alpha$ is a positive scalar search speed parameter, which must be sufficiently small to ensure convergence of the search. The gradient of the magnitude squared error with respect to the control filter can be estimated, using finite difference approximations, as:

$$\frac{\partial e^2}{\partial H_k} = \frac{e^2(H_k + \Delta H) - e^2(H_k)}{\Delta H} \tag{3}$$

where ΔH is a small perturbation in the filter configuration.

The optimisation strategy described by equations (2) and (3) above has been found to converge in experiments at a single frequency ω/20π, i.e:

$$\lim_{K\to\infty}[H_k(\omega)] = H_{opt}(\omega) \tag{4}$$

In the analysis discussed above, a single frequency has been assumed. In practice, the filter 12A need to have a frequency selective behavior. In order to design the optimal filter for a range of frequencies, the process described above needs to be conducted at each of a number of frequencies within the audio band, in which case all of the variables are to be interpreted as complex functions of frequency ω, and the perturbation ΔH should involve perturbations of both the real and imaginary components.

A prototype loudspeaker system has been constructed, as described above, using a mid-range horn having a mouth 54×29 cm and a mouth-to-throat dimension of 30 cm along the axis of the horn. A pair of 110 mm diameter cone units, were arranged as secondary left and right drivers 32L, 32R, with their axes spaced by a distance of 25 cm from the mouth 30 of the horn 22, as measured along the wall of the horn 22. A digital signal processor, capable of introducing variable phase shifts and gains to a sinusoidal input, was used as the azimuth filter 12A. The polar response was measured using one microphone disposed on the axis 28 and further nine microphones at the same elevation, equispaced from the acoustic centre of the loudspeaker 10, and angularly spaced by 70°/9(=7.8°) from each other. The filter 12A was optimised to attempt to produce a highly directional frequency-independent 30°×30° horizontal radiator.

Figure 3:
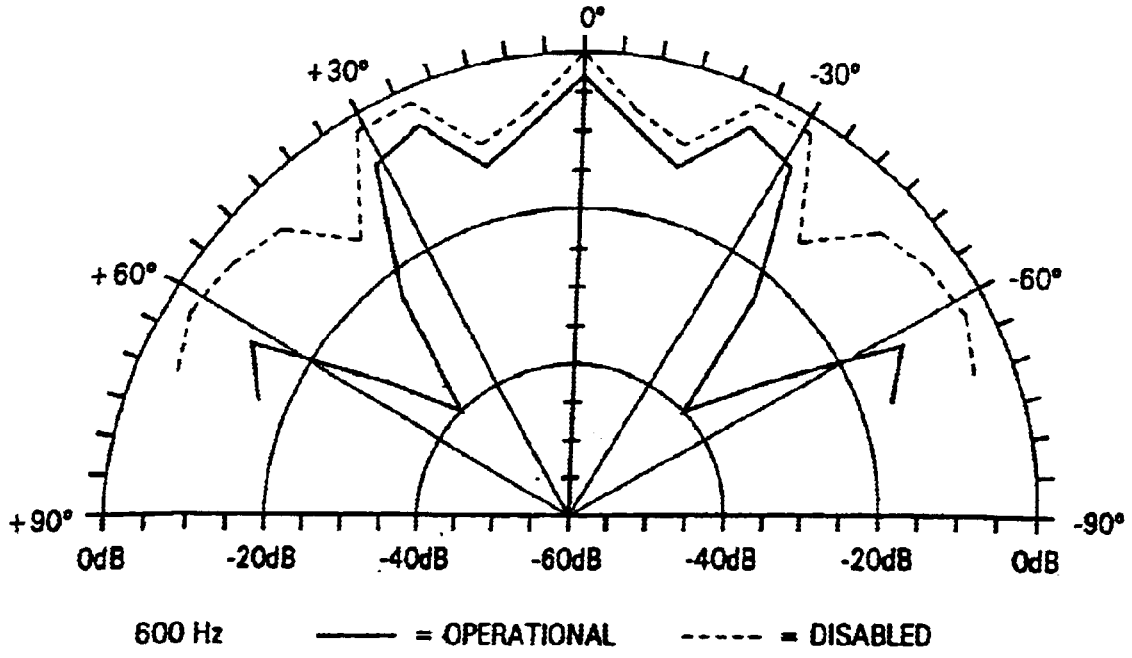
FIG. 3 is a polar diagram of the response of an embodiment of loudspeaker system at a frequency of 600 Hz.
Figure 4:
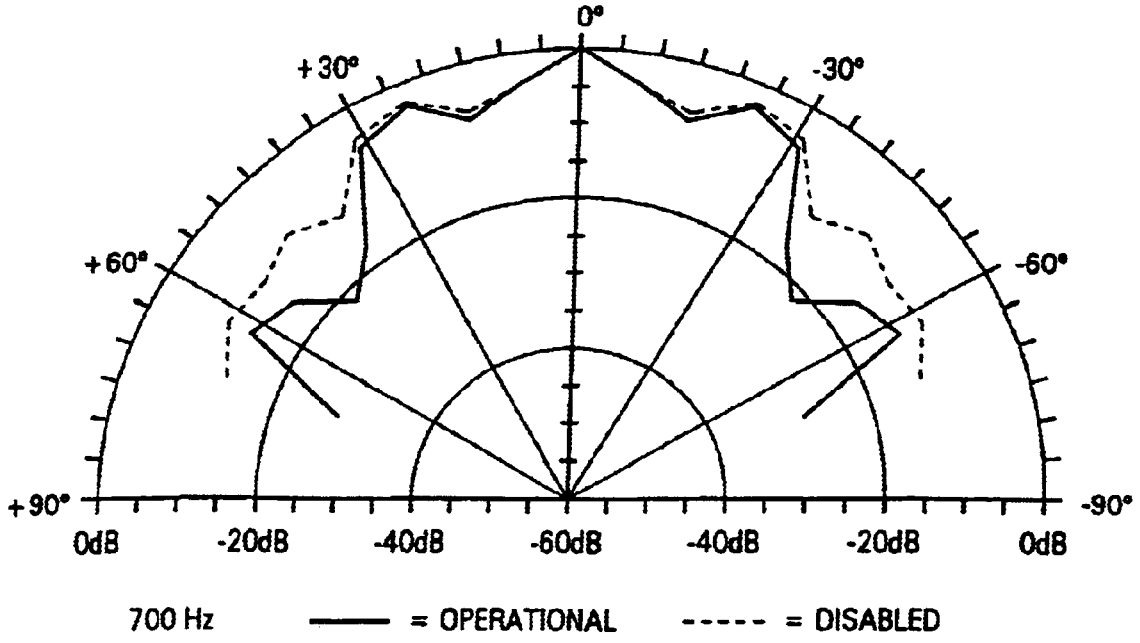
FIGS. 4 and 5 are polar diagrams similar to FIG. 3, but a frequencies of 700 Hz and 1 kHz.
Figure 5:
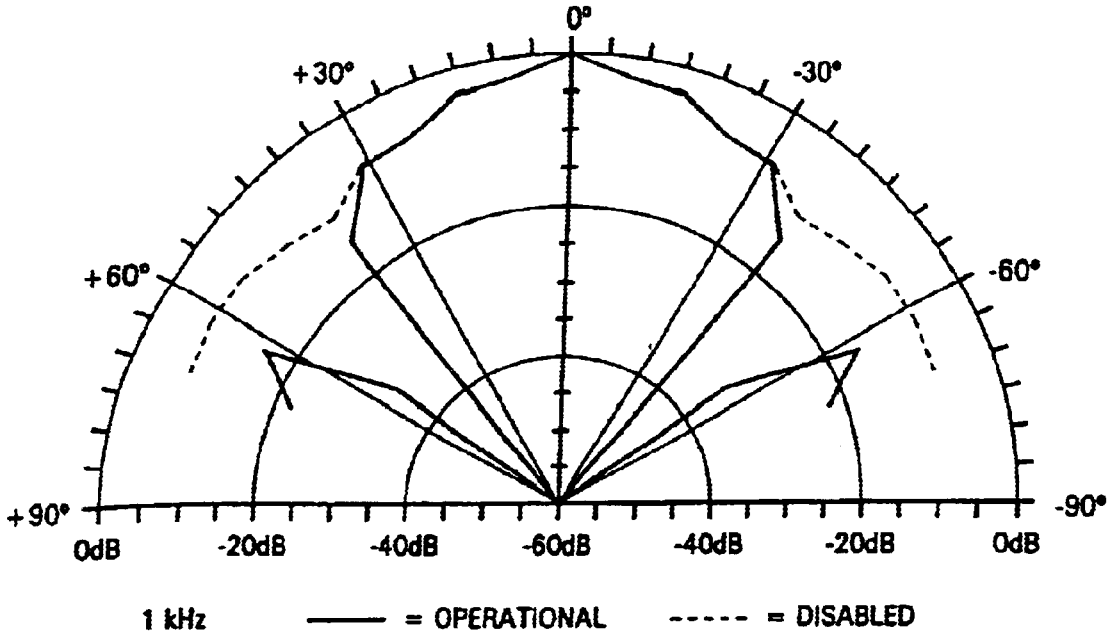

The polar response of the system is shown in FIGS. 3 to 5 at frequencies of 600 Hz, 700 Hz, and 1 kHz, respectively. In those drawings, the thicker continuous-line trace shows the response with the secondary drivers 32L, 32R operational, and the dashed line trace shows the response with the secondary drivers 32L, 32R disabled. The microphones were in the angular range from 0° to +70°, and the response in the range from 0° to −70° has been assumed to be a mirror image due to the symmetry of the system. As can be seen from FIGS. 3 to 5, enabling the secondary drivers 32L, 32R produces an insignificant change in the response in the range −30° to +30°, but causes significant attenuation outside of that range, thereby improving the directionality of the horn.

Figure 6:
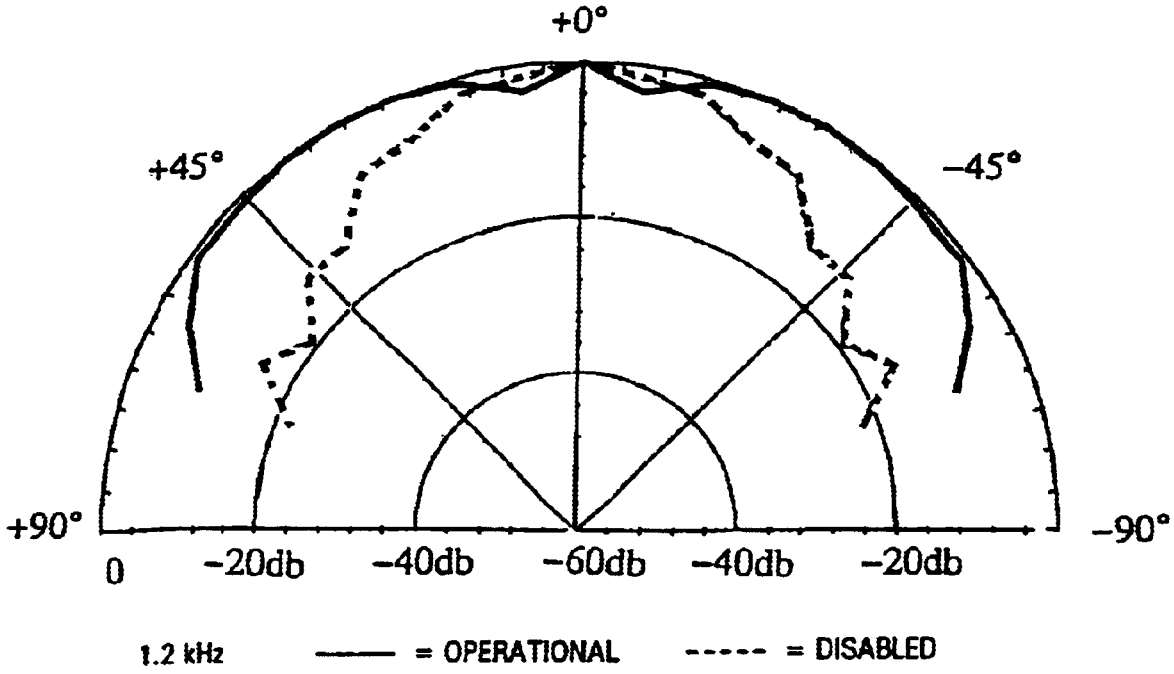
FIG. 6 is a polar diagram of another embodiment of loudspeaker system at 2 KHz.

It will be appreciated that the invention can be equally applied to reducing directionality. Thus, FIG. 6 illustrates the polar response of a system in which the digital signal processing is such that when the secondary drivers 32L, 32R are enabled, the response in the range +55°to −55° is substantially constant, whereas without the secondary drivers the response falls off markedly outside the range ±15°.

For all embodiments, once the required filter characteristics have been determined using the method described above, the digital signal processor used as the filter 12A, 12E, may be replaced by a dedicated filter or other signal processor which provides the required characteristics or a selectable set of such characteristics.

Figure 2:
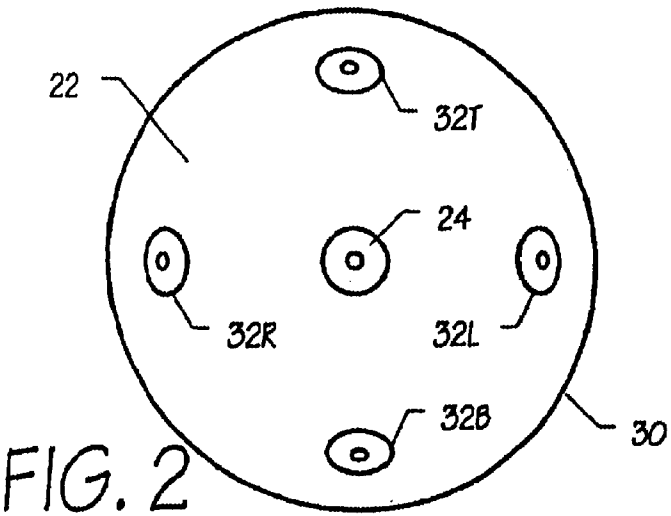
FIG. 2 is a schematic end view of the system of FIG. 1 in the direction II shown in the figure.

Having described in detail an embodiment and example of the present invention, it will be appreciated that many modifications and developments may be made thereto. For example, as described above, two or four of the secondary drivers may be employed; indeed, any other number of such drivers may be used, for example one or three of them. If an asymmetric polar response is required, each secondary driver can be provided with its own signal processing circuit, or asymmetrically-arranged secondary drivers may be driven by a common signal processing circuit. As shown in FIG. 2, the shape of the horn 22 in planes at right angles to the axis 28 is circular. Other cross-sectional shapes may be used, such as square, rectangular and elliptical. As mentioned above, in FIG. 1, the horn 22 is shown as having a conical flare, but preferably an exponential or hyperbolic flare is used. Each feature disclosed in this specification (which term includes the claims) and/or shown in the drawings may be incorporated in the invention independently of other disclosed and/or illustrated features.

The text of the abstract filed herewith is repeated here as part of the specification. A horn loudspeaker comprises a horn 22 having a throat 26 and a mouth 30; a primary electro-acoustic driver 24 mounted at or adjacent the throat of the horn and directed generally along the horn; and at least one secondary electro-acoustic driver 32T, 32B, 32L, 32R mounted partway along the horn and directed generally across the horn. The secondary driver(s) can be used to change the local impedance conditions in the horn and therefore to change the polar response of the horn loudspeaker. At least one filter 12A, 12E is provided for filtering an input signal 34 for the primary driver to produce a filtered signal for the primary driver or each of the secondary drivers. Such a filter may be chosen or designed so as to optimise some aspect of the polar response of the horn loudspeaker, for example to increase directivity, or flatten the polar response within a specified included radiation angle, or to increase omnidirectionality.

It is appreciated that various modifications to the inventive concepts described herein may be apparent to those skilled in the art without departing from the spirit and scope of the present invention as defined by the hereinafter appended claims.

What is claimed is:

1. A horn loudspeaker, comprising:

a) a horn having a throat and a mouth;

b) primary electro-acoustic driver mounted at or adjacent the throat of the horn and directed generally along the horn; and c) at least one secondary electro-acoustic driver mounted part-way along the horn, spaced from the throat, and directed generally across the horn.

2. The horn loudspeaker system of claim 1 further including a signal processor for processing input signals to at least one said secondary driver to control the polar response of the horn loudspeaker.

3. The horn loudspeaker of claim 1 including at least two secondary drivers.

4. The horn loudspeaker of claim 3 wherein the secondary drivers are arranged as one or more pairs, the drivers of each pair being arranged generally symmetrically with respect to the horn axis and having their electrical inputs connected in phase with each other.

5. The horn loudspeaker of claim 4 including at least two pairs of secondary drivers.

6. The horn loudspeaker of claim 5 wherein:

a) the drivers of a first of the pairs are directed generally in a first plane generally across the axis of the horn; and b) the drivers of a second of the pairs are directed generally in a second plane, generally at right angles to the first plane, generally across the axis of the horn.

7. The horn loudspeaker of claim 1 wherein the secondary driver, or at least one of the secondary drivers, is disposed nearer the mouth than the throat of the horn.

8. The horn loudspeaker of claim 1 wherein the horn has an exponential or hyperbolic taper.

9. The horn loudspeaker of claim 1 wherein the primary driver or the at least one secondary driver is mounted in the wall of the horn and is directed generally at right angles to the portion of the wall in which it is mounted.

10. A horn loudspeaker system, comprising:

a) a horn having a throat and a mouth;

b) a primary electro-acoustic driver mounted at or adjacent the throat of the horn and directed generally along the horn;

c) at least one secondary electro-acoustic driver in a side surface of the horn and directed generally across the horn; and d) a signal processor for processing input signals to at least one said secondary driver to control the polar response of the horn loudspeaker.

11. The horn loudspeaker system of claim 10 wherein the signal processor processes an input signal for the primary driver to produce a processed signal for the primary driver or the at least one secondary driver.

12. The horn loudspeaker system of claim 10 wherein the signal processing characteristic of the signal processor is adjustable.

13. The horn loudspeaker system of claim 12 further including:

a) an amplifier for amplifying the input signal for supply to the primary driver; and b) an amplifier for amplifying the processed signal for supply to the at least one secondary driver.

14. The horn loudspeaker system of claim 10 wherein at least two pairs of secondary drivers are provided, and the signal processor provides a first processed input signal for one of the pairs of secondary drivers and a second processed input signal for another pair of secondary drivers.

15. The horn loudspeaker system of claim 10 wherein the signal processor selects at least one frequency component of the input signal for processing.

* * * * *